United States Patent [19]

Watanabe et al.

[11] Patent Number: 4,653,097

[45] Date of Patent: Mar. 24, 1987

[54] INDIVIDUAL VERIFICATION APPARATUS

[75] Inventors: Sadakazu Watanabe, Kawasaki; Hidenori Shinoda, Yokohama, both of Japan

[73] Assignee: Tokyo Shibaura Denki Kabushiki Kaisha, Kawasaki, Japan

[21] Appl. No.: 870,309

[22] Filed: May 23, 1986

Related U.S. Application Data

[63] Continuation of Ser. No. 460,379, Jan. 24, 1983, abandoned.

[30] Foreign Application Priority Data

Jan. 29, 1982 [JP] Japan ..... 57-12768

[51] Int. Cl.[4] ..... G10L 5/00

[52] U.S. Cl. ..... 381/42; 381/51; 364/513.5

[58] Field of Search ..... 381/41-43; 340/825.33, 825.34

[56] References Cited

U.S. PATENT DOCUMENTS

| | | | |
|---|---|---|---|
| 3,742,451 | 6/1973 | Graham et al. | 340/149 A |
| 3,896,266 | 7/1975 | Waterbury | 381/42 |
| 4,078,154 | 1/1980 | Suzuki . | |
| 4,418,412 | 11/1983 | Kariya | 381/43 |
| 4,454,586 | 6/1984 | Pirz et al. | 381/41 |

OTHER PUBLICATIONS

Proceedings of the 1979 Carnahan Conference on Crime Countermeasures, May 16-18, 1979, J. P. Woodard et al: "Automatic Entry Control for Military Applications", pp. 65-76, *p. 68, left-hand column, lines 20-26*.

Proceedings of the Carnahan Conference on Electronic Crime Countermeasures, 1976, pp. 23-30, W. Haberman et al: "Automatic Identification of Personnel through Speaker and Signature Verification-System Descrip. and Testing", *Paragraph Auto. Speaker.

Electronics, vol. 53, No. 2, 27th Jan. 1981, pp. 53, 55, New York, USA, P. Hamilton, "Just a Phone Call Will Transfer Funds", *Whole article*.

*Primary Examiner*—E. S. Matt Kemeny

*Attorney, Agent, or Firm*—Oblon, Fisher, Spivak, McClelland & Maier

[57] ABSTRACT

Speaker verification is tested in a sequence of steps: speech recognition of the spoken identification code (key code) is followed by speaker verification using the sounds of the spoken identification code. If verification fails, the speaker is urged by a speech synthesizer to utter his or her name for speaker verification.

6 Claims, 11 Drawing Figures

FIG. 2A

| KEY CODE | REGISTERED NUMBER | POINTER TO INDIVIDUAL FILE |
|---|---|---|
| 0000 | 2 | 1 |
| 0001 | 7 | 3 |
| ⋮ | ⋮ | ⋮ |
| n1n2n3n4 | Nn | An |
| ⋮ | ⋮ | ⋮ |

FIG. 2B

| POINT-ER | KEY CODE | REGISTERED NUMBER | INTERNAL CODE | NAME | POINTER TO REF. DATA 1 | POINTER TO REF. DATA 2 |
|---|---|---|---|---|---|---|
| 1 | 0000 | | 001001 | | | |
| ⋮ | | | | | | |
| An | n1n2n3n4 | Nn | | | | |
| | | | An001 | ABRAM | Pn1 | Qn1 |
| | | | | ADAM | Pn2 | Qn2 |
| | | | | ⋮ | ⋮ | ⋮ |

INDIVIDUAL VERIFICATION APPARATUS

This application is a continuation of application Ser. No. 460,379, filed Jan. 24, 1983, now abandoned.

BACKGROUND OF THE INVENTION

The present invention relates to an individual verification apparatus and, more particularly, to an individual verification apparatus for verifying a speaker on the basis of his speech.

In a cash card system or an automated teller machine system in banks, individual verification is performed by identifying an ID number keyed in by a customer with the ID number magnetically recorded on his ID card or debit card. Such individual verification can be realized with simple logical operations and hence is widely used.

However, if the user loses his ID card, the verification becomes impossible. Furthermore, if somebody happens to know the ID number on the lost ID card, he may be able to withdraw money from an account which does not belong to him.

SUMMARY OF THE INVENTION

It is an object of the present invention to provide an individual verification apparatus which is capable of verifying an individual easily and reliably by using only the speech of the individual.

An individual verification system of the present invention comprises a verification data file, a speech input section, a data memory, a speech recognition circuit, and a speaker verification circuit. Key codes, that is identification codes set by customers and reference data of the key codes spoken by the customers are registered in the verification data file. When a customer utters his key code to claim the verification, speech data is stored in the data memory through the speech input section. The speech recognition circuit recognizes the uttered on spoken key code (i.e. the identification code). When the customer confirms the recognized key code which is audibly indicated by a speech response section, the speaker verification circuit verify the speech data of the customer's key code stored in the data memory with the reference data of the customer for the recognized key code which is stored in the verification data file to accept or reject the verification claim of the customer.

According to the present invention, speech recognition and speaker verification need only be performed for a speech of a limited number of words such as a key code. For this reason, the recognition and verification can be easily performed as compared with a case where recognition and verification must be performed for indefinite speech words. In other words, the system of the present invention allows a highly reliable individual verification.

Individual verification for the name speech data of customers name may also be performed so as to further improve the verification precision. In this case, reference data for the names of customers are also registered in the verification data file in addition to the key codes and the reference speech patterns thereof.

BRIEF DESCRIPTION OF THE DRAWINGS

FIGS. 2A to 2D show the configuration of the verification data file; and

DETAILED DESCRIPTION OF THE PREFERRED EMBODIMENT

Figure 1:
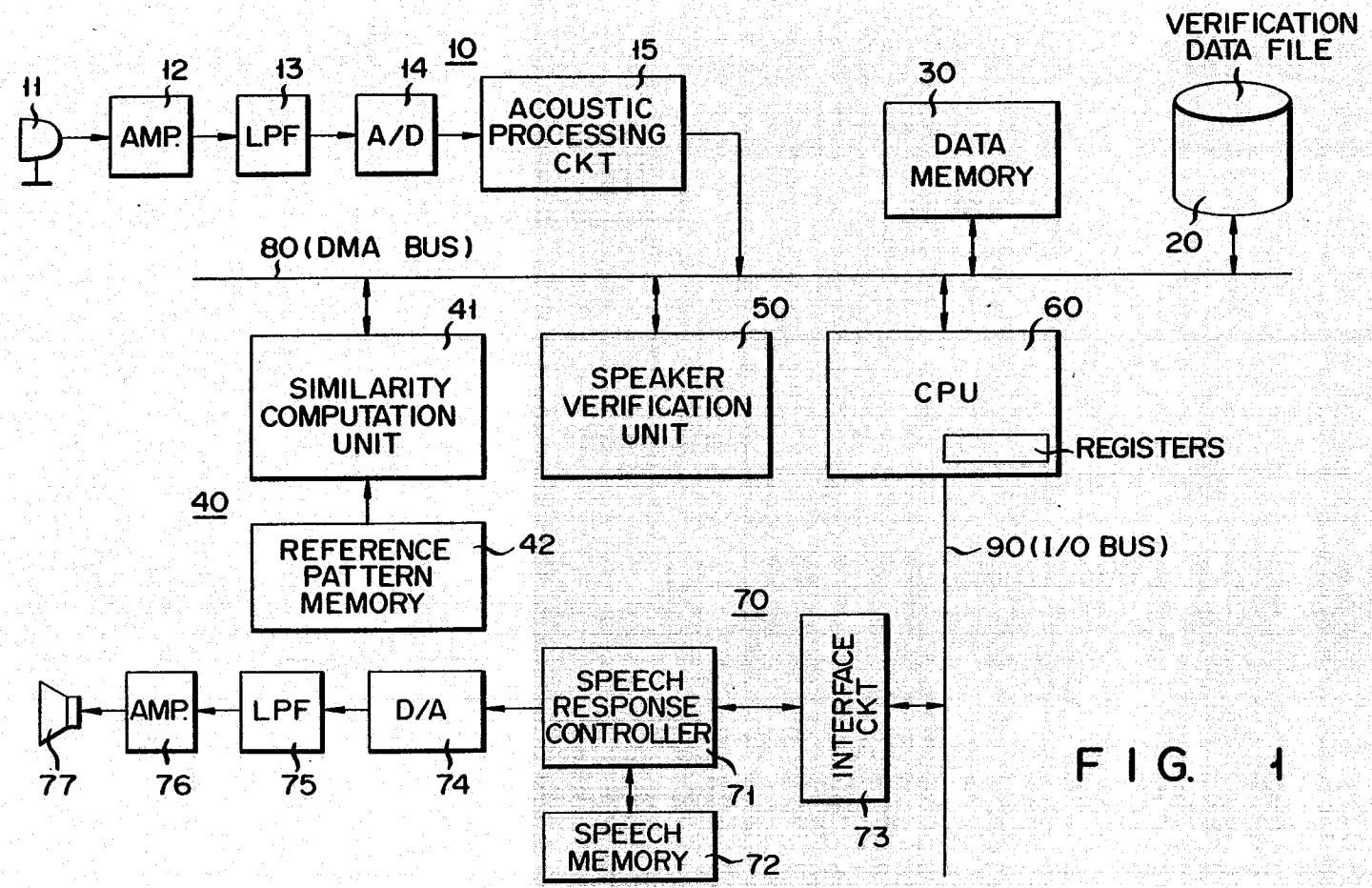
FIG. 1 is a block diagram of an individual verification system according to the present invention.

Referring to FIG. 1, an individual verification system of the present invention comprises a speech input section 10, a verification data file 20, a data memory 30, a speech recognition section 40, a speaker verification unit 50, and a control section (CPU) 60. These parts are connected to a direct memory access (DMA) bus 80. A speech response section 70 is connected to CPU 60 through an I/O bus 90.

Speech input section 10 includes a microphone 11, an amplifier 12, a low-pass filter 13, an analog-to-digital (A/D) converter 14, and an acoustic processing circuit 15. Speech input section 10 processes in a well known manner an audio input signal of a speaker obtained through microphone 11 to obtain digital imformation necessary for speech recognition and speaker verification. The digital information from speech input section 10 is temporarily stored in data memory 30 to be utilized later for the speech recognition (key code recognition) and individual verification. According to the present invention, a customer is required to speak some of numbers from "0" to "9" for a key code such as a 4-digit ID number and confirmation words of "YES" and "NO". Alternatively, the key code may be a specific word.

The speech response section 70 comprises a speech response controller 71, a speech memory 72, an interface circuit 73 for coupling controller 71 to I/O bus 90, a digital-to-analog (D/A) converter 74, a low-pass filter 75, an amplifier 76, and a loudspeaker 77. Speech response section 70 sequentially reads out word data for forming particular sentences necessary for individual verification from speech memory 72 under the control of CPU 60. The sentences are audibly indicated to the customer through loudspeaker 77.

Verification data file 20 is a large-capacity memory such as a magnetic drum or a magnetic disc, which stores, in advance, key codes set by customers, reference data for verification of key codes uttered by the customers, and also reference data of names for verification uttered by the customers.

Speech recognition section 40 comprises a similarity computation unit 41 and a speech reference pattern memory 42. The speech reference pattern memory 42 stores speech reference patterns of an indefinite speaker for numbers "0" to "9" and the words "YES" and "NO". Speech recognition section 40 recognizes an input speech from speech input section 10 by computing the similarity between the input speech pattern and the speech reference pattern stored in speech reference pattern memory 42.

Speaker verification unit 50 performs speaker verification by measuring the distance between the input feature vector extracted from the speech input and the speech reference data vector registered in verification data file 20. Speaker verification is performed, after speech recognition of the key code, for a plurality of customers having the same key code. Speech recognition and speaker verification may be performed in a conventional manner.

The configuration of verification data file 20 will briefly be described with reference to FIGS. 2A to 2D.

FIG. 2A shows a file pointer table. The table shows the registered number of each key code and pointers to individual files. In the case of a key code of $n_1n_2n_3n_4$, it is seen that the registered number of the key code or the number of customers having this key code is Nn, the pointer to the individual file is An, and the pointer to the reference data is Bn.

FIG. 2B shows a pointer table to data. In this table, names are sorted in the alphabetical order for each key code. According to this table, names of the Nn customers having a key code $n_1n_2n_3n_4$ are alphabetically sorted. A pointer to a reference data 1 for number speech and a pointer to a reference data 2 for name speech are respectively assigned to each customer. For example, Mr. Abram having the key code $n_1n_2n_3n_4$ has pointers $Pn_1$ and $Qn_1$ to the reference data 1 and 2, respectively. Internal codes are also assigned to the respective customers.

Figure 2C:
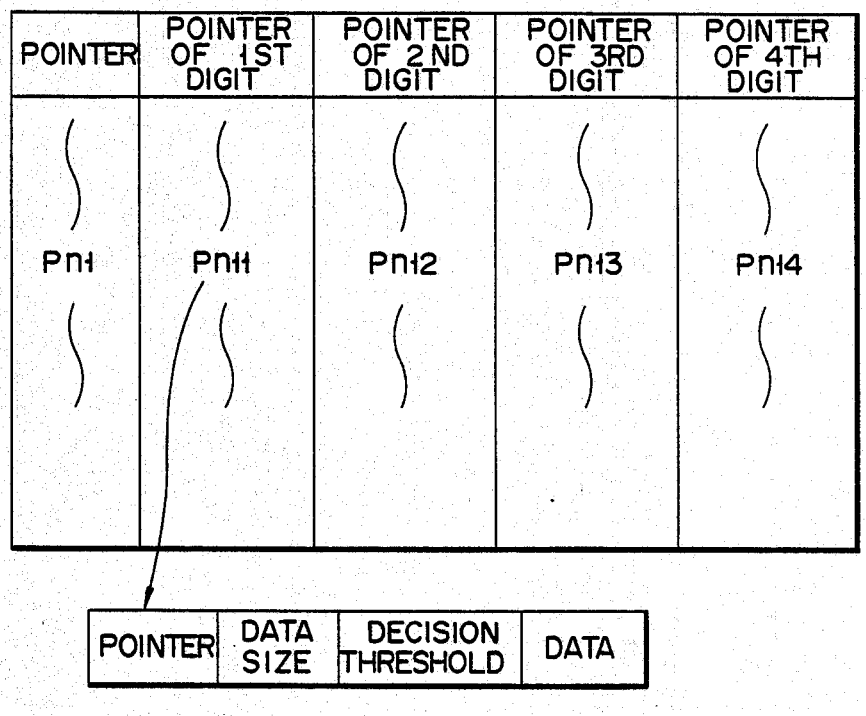

FIG. 2C shows a data file of the reference data 1. In the case of Mr. Abram, pointers to the reference data for the respective digits of the 4-digit key code are represented by $Pn_{11}$, $Pn_{12}$, $Pn_{13}$ and $Pn_{14}$. The data of each digit consists of a data size, a decision threshold value, and speaker verification data such as cepstrum coefficients.

Figure 2D:
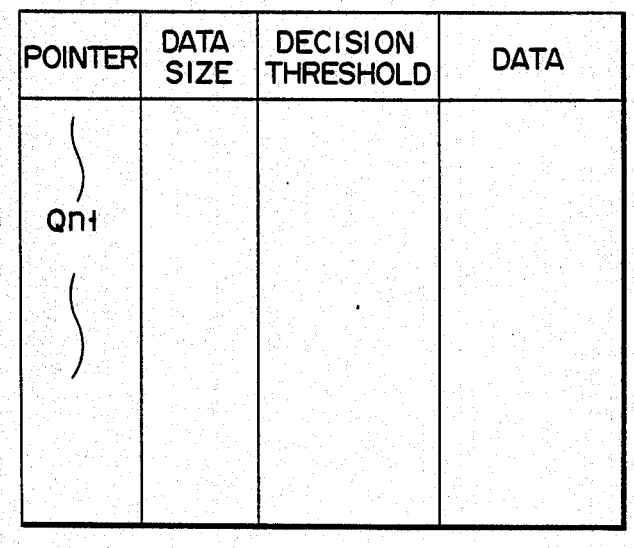
Figure 3:
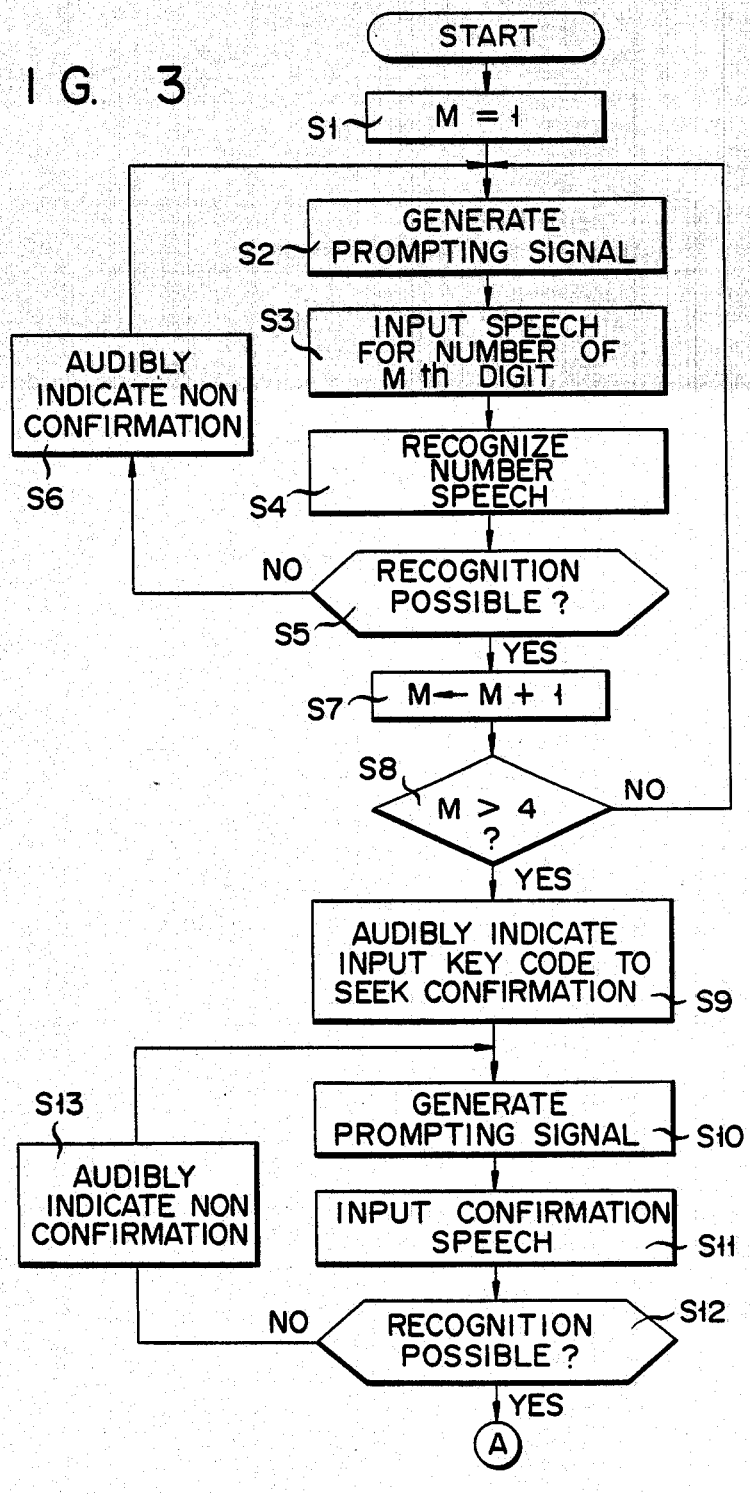
FIGS. 3 to 8 are flowcharts for explaining the operation of the individual verification system of the present invention.

FIG. 2D shows a data file of the reference data 2. The reference data of the name also consists of a data size, a decision threshold value and speaker verification data.

The operation of the individual verification apparatus shown in FIG. 1 will now be described with reference to the flowcharts shown in FIGS. 3 to 8. A case will be considered wherein the key code is a 4-digit number.

A customer initializes the apparatus. This may be automatically performed. Then, an M register of CPU 60 is set to 1 in step S1. Then, under the control of CPU 60, speech response section 70 utters a message "Please state your key code one digit at a time after each signal" on the basis of the sentence data stored in speech memory 72. Then, in step S2, a prompting signal "Pee" is sounded. In step S3, the customer utters the number of the Mth digit of his key code such as "0123". Since M=1 in this case, he utters "zero". The speech data through acoustic processing circuit 15 is stored in data memory 30. In step S4, the input speech data is read out of data memory 30 and applied to speech recognition circuit 40 for speech recognition. In step S5, it is decided if the speech recognition could be done. If "NO" in step S5, a message "Cannot confirm. Please repeat the digit again." is generated by speech response section 70 in step S6. Then, the operation is repeated from step S2.

On the other hand, if "YES" in step S5, the content of the M register is incremented by 1 in step S7. In step S8, it is decided if the content of the M register is more than 4, that is, if the recognition for all the four digits of the key code has been completed. If "NO" in step S8, the operation is repeated from step S2 again for recognition of the respective digits of the key code. The recognition result or recognized number is stacked in data memory 30.

If "YES" in step S8, the operation advances to step S9. In step S9, CPU 60 fetches the input key code from data memory 30 and allows speech response section 70 to produce a message "Your key code is zero, one, two, three." to seek confirmation of the customer. In step S10, a prompting signal is generated. After the prompting signal ceases to be generated, the customer utters a confirmation word "YES" or "NO" in step S11. The uttered confirmation word is recognized by speech recognition circuit 40. In step S12, it is decided if recognition of the confirmation word is possible. When the input speech cannot be recognized a message indicating non-confirmation of the input speech is generated by speech response section 70 in step S13. The operation then returns to step S10 to repeat the above-mentioned operation.

Figure 4:
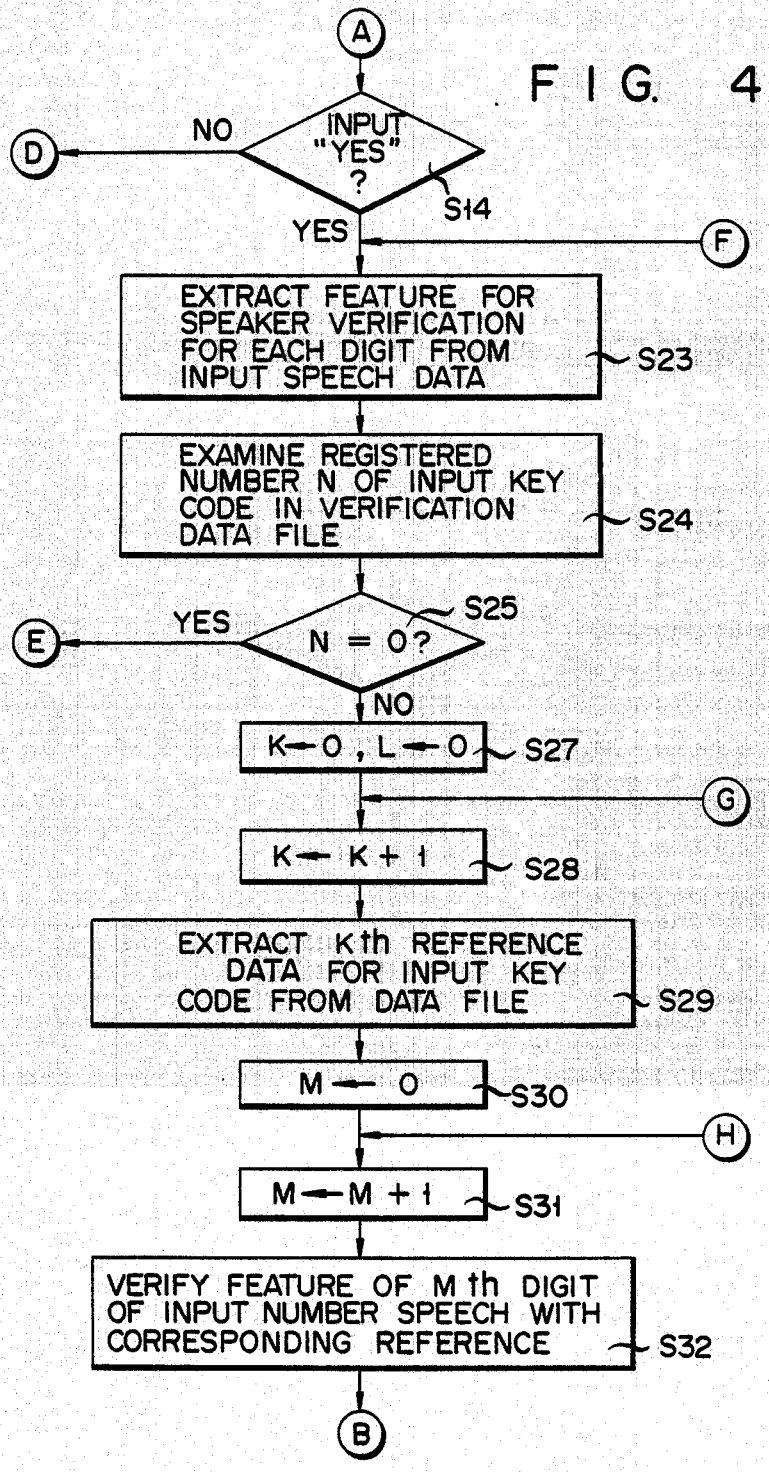
Figure 5:
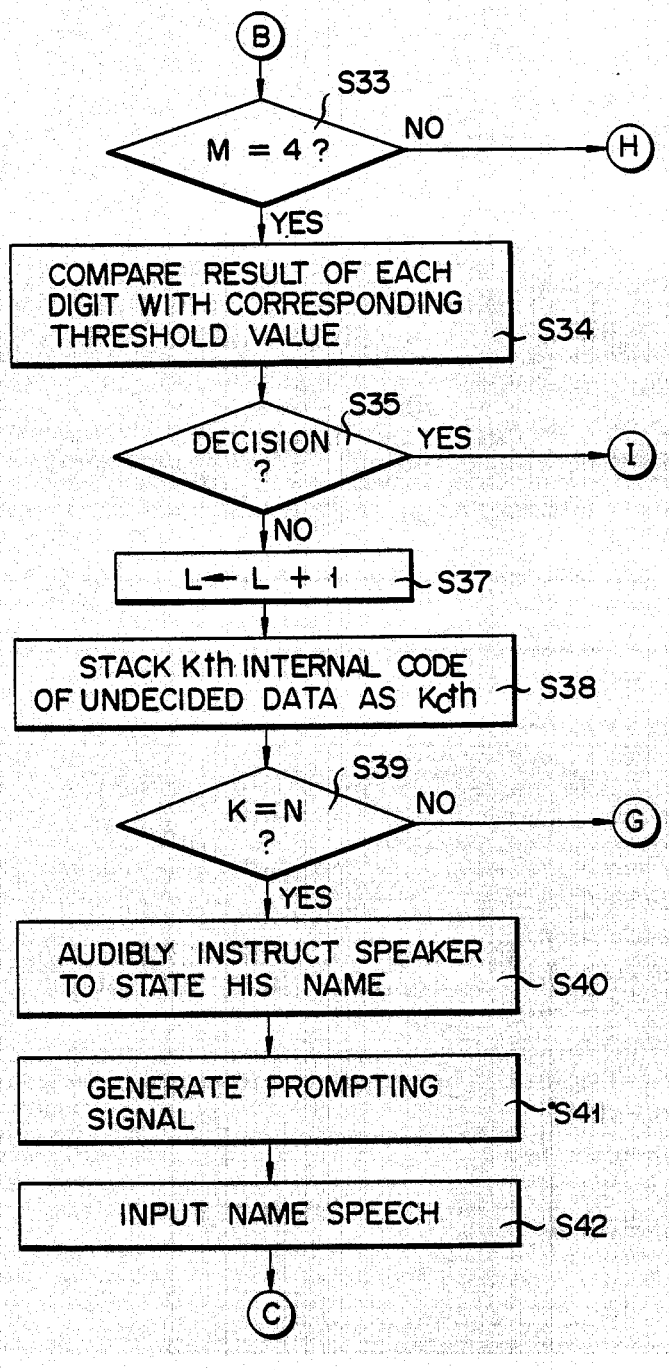

If "YES" in step S12, the operation advances to step S14 in FIG. 4. In step S14, it is decided if the confirmation input speech is "YES".

Figure 7:
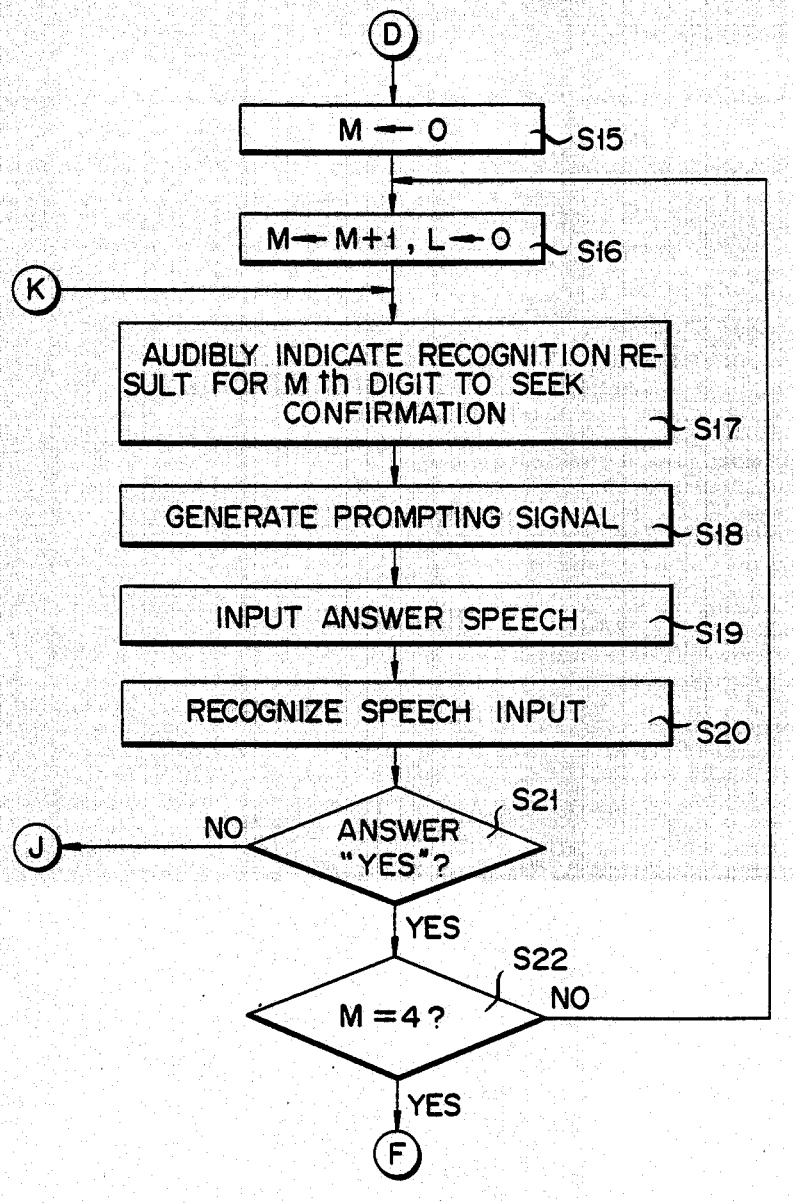
Figure 8:
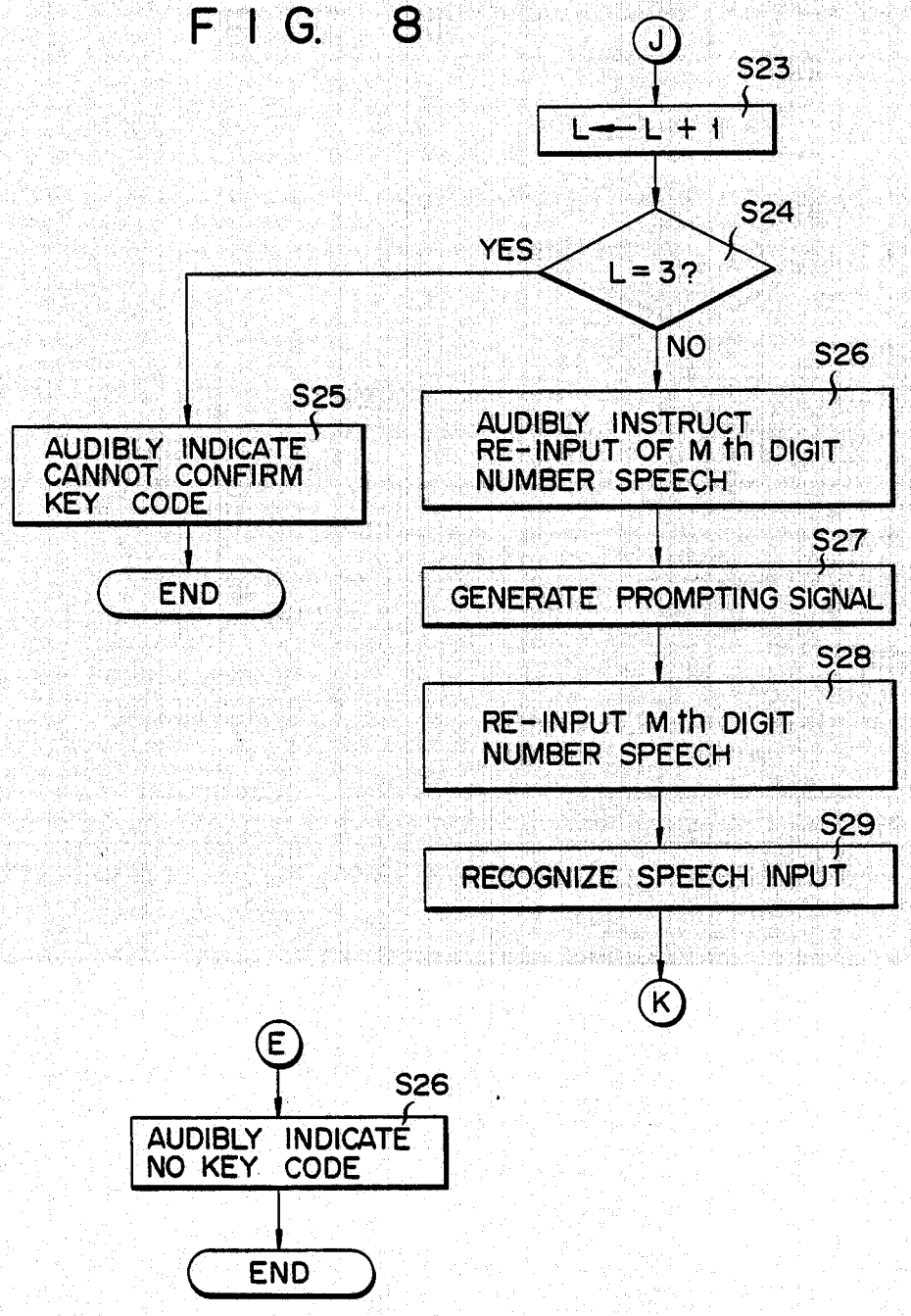

If "NO" in step S14, in other words, if the input key code recognized by the system includes an error, correction processing for each digit of the key code is performed starting from step S15 in FIG. 7. Assume that the number of the second digit position has been erroneously recognized by the system.

In step S15, the M register in CPU 60 is reset to 0. In step S16, the content of the M register is incremented by 1 and an L register is reset to 0. In step S17, speech response section 70 generates a message "Please confirm one digit at a time. The first digit is zero." to seek the confirmation of the customer. After a prompting signal is generated in step S18, an answer speech is produced by the customer in step S19. In step S20, the input answer speech is recognized. It is decided in step S21 if the answer speech is "YES". If "YES" in step S21, it is then decided in step S22 if the content of the M register is 4. At this time, the processing of the first digit is being performed. Therefore, "NO" will result in step S22 and the operation returns to step S16. In step S16, the M register is incremented by 1 and the processing of the number of the second digit of the key code is then performed in the same manner as described above. Since the system error is involved in the recognition of the second digit, "NO" results in step S21 and the operation advances to step S23 in FIG. 8.

In step S23, the L register is incremented by 1. In step S24, it is decided if the content of the L register is 3. The content of the L register indicates the time of correction operations. If the recognized number cannot be corrected by two-time correction operations, that is, if "YES" in step S25, speech response section 70 produces a message "Cannot confirm your key code." in step S25.

If the content of the L register is 2 or less, that is, if "NO" in step S25, the operation advances to step S26 wherein speech response section 70 produces a message "State the digit once more". A prompting signal is generated in step S27, and the customer states the number of the digit in step S28. The input speech data is substituted for the data of the same digit which is stored in data memory 30. In step S29, recognition of the re-input speech data is performed. The recognition result is audibly indicated to the customer in step S17 (FIG. 7). If the number of the Mth digit which has been erroneously recognized before is corrected, "YES" results in step S21. The operation then advances to step S22. In step S22, it is decided if the content of the M register is 4. If "NO" in step S22, the operation returns to step S16. In step S16, the content of the M register is incremented by 1, and the L register is reset to 0. As a result, the operation as described above is repeated for all the remaining digits of the input key code. When the confirmation operation is completed for all the digits, the operation advances from step S22 to step S23 (FIG. 4).

The operation as described above is for recognition of the input key code. Subsequently, processing for speaker verification is performed.

In step S23 (FIG. 4), the features for speaker verification are extracted for each digit from the input speech data stored in data memory 30. The extracted features are stored in speaker verification unit 50. In step S24, the registered number (N) of the input key code in verification data file 20 is examined. The examined number is stored in an N register in CPU 60. In the example shown in FIG. 2A, the registered number of the key code $n_1n_2n_3n_4$ is Nn.

In step S25, it is decided if the registered number is 0. If "YES" in step S25, speech response circuit 70 audibly indicates, in step 26 (FIG. 8), that no key code is registered.

If "NO" in step S25 (FIG. 4), the K and L registers in CPU 60 are reset to 0 in step S27, and the K register is incremented by 1 in step S28.

In step S29, the Kth reference data of the input key code is extracted from verification data file 20 and is transferred to speaker verification unit 50. The pointer to the first (specified by the internal code) reference data 1 of the input key code $n_1n_2n_3n_4$ is $Pn_1$ as shown in FIG. 2B. The first reference data is extracted as shown in FIG. 2C on the basis of this pointer.

In step S30, the M register is reset. Subsequently, the M register is incremented by 1 in step S31. In step S32, the feature of the Mth digit of the input number speech is verified with the corresponding reference data by speaker verification unit 50.

In step S33, it is decided if the content of the M register is 4. If "NO" in step S33, steps S31 and S32 are repeated. When the verification for all the 4-digits is completed, the operation advances to step S34. In step S34, the verification result of each digit is compared with a corresponding decision threshold. According to the comparison result, it is decided in step S35 if the input key code has been verified.

Figure 6:
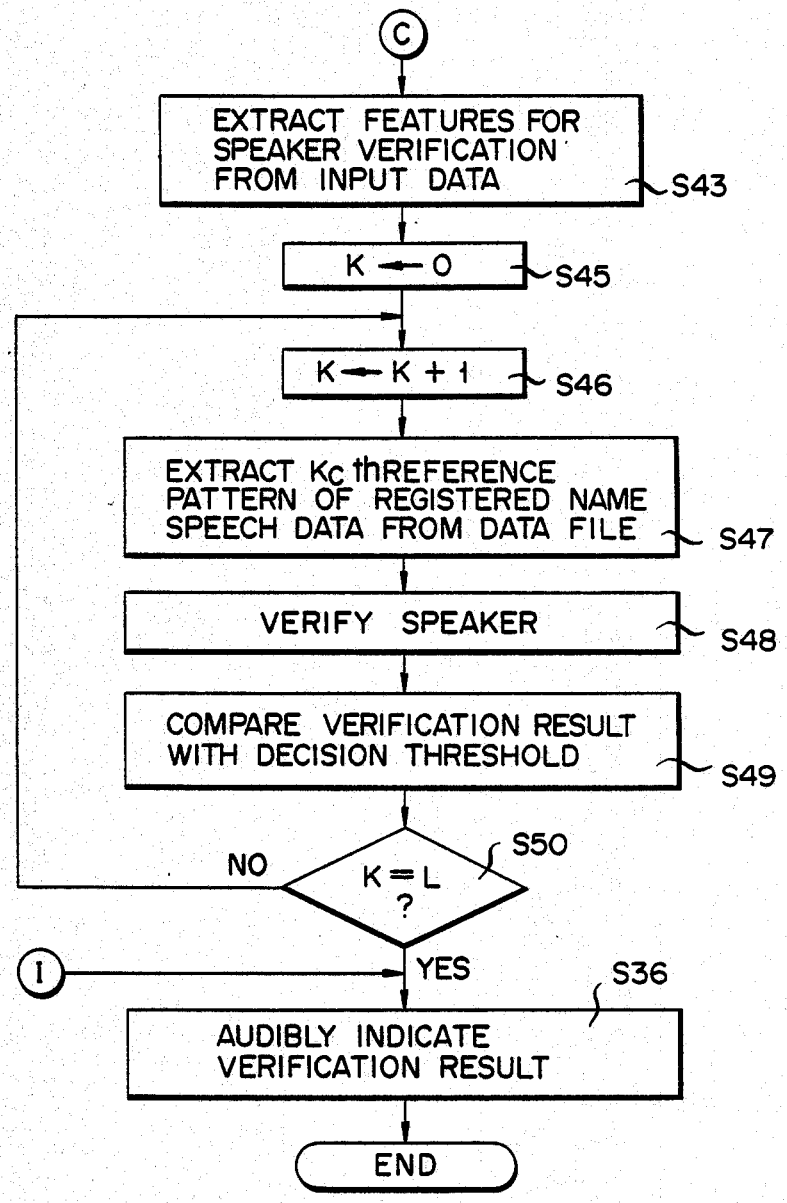

If the verification is confirmed in step S35, the verification result is audibly indicated in step S36 (FIG. 6). In this case, speech response section 70 produces a message "Confirmation is completed".

When the decision on the speaker verification cannot be made in step S35, the L register of CPU 60 is incremented by 1 in step S37. In step S38, the number $K_c$ (internal code in FIG. 2B) of the undecidable data is stacked in data memory 30. In step S39, it is decided in step S39 if the content of the K register is equal to N. If "NO" in step S39, operations following step S28 are repeated to perform speaker verification of the input key code with the remaining reference data.

If "YES" in step S39, that is, if the speaker verification cannot be made by the speech of the input key code, speaker verification is performed by the name speech. This is because the speaker verification is possible on the basis of the name speech even if the speaker verification cannot be performed by the speech of the input key code.

In step S40, speech response section 70 produces a message "Please state your name". A prompting signal is generated in step S41, and the customer states his name and the name speech is input in step S42. The name speech data is stored in data memory 30.

In step S43, the feature data for speaker verification is extracted from the input speech data stored in data memory 30 and transferred to speaker verification unit 50. The K register is reset to 0 in step S45, and the K register is incremented by 1 in step S46. In step S47, the reference data of the registered name speech data which has the internal code $K_c$ in the Kth stack is extracted from the data of customers having the same key code registered in verification data file 20 and transferred to verification unit 50. The name speech reference data is fetched from the data file as shown in FIG. 2D which is specified by the pointer Qn shown in FIG. 2B.

In step S48, the distance between the features of the input name speech data and the reference data is measured in speaker verification unit 50. In step S49, the measured distance is compared with a decision threshold. In step S50, it is decided if the content of the K register is equal to L, that is, if the speaker verification based on the name speech has been made for all the undecidable data. If "NO" in step S50, the operation returns to step S46 to perform speaker verification for the remaining reference data. In this case, a person having a reference data which provides a measured distance greater than the decision threshold is determined to be the speaker. If the measured distance does not exceed the threshold value, the speaker is determined to be a non-registered person. Based on the verification result, speech response section 70 produces a message "Sorry to have kept you waiting. Confirmation is completed." or "Sorry to have kept you waiting. Cannot confirm. Please repeat the procedure." in step S36.

As can be seen from the above description, in the individual verification system of the present invention, the speech response is made in the form of a predetermined sentence or a sentence having a number speech or speeches inserted.

Speech response control will now be briefly described. A predetermined sentence, for example, "Please state your key code one digit at a time after each signal" is produced in accordance with the following procedures.

First, CPU 60 generates a command to initialize speech response section 70 and issues an output code A for designating the above sentence to speech response controller 71. Speech response controller 71 retrieves a memory address of output speech data corresponding to the output code A and reads out the output speech data from speech memory 72. The speech data is read out until an END mark is read. The readout speech data is converted into an analog signal and drives loudspeaker 77. When the END mark of data is read out, speech response controller 71 informs CPU 60 of the completion of the speech output. CPU 60 then performs next operations.

A sentence having a number word inserted such as "Please confirm one digit at a time. The first digit is zero." is produced in the following manner. CPU 60 supplies output codes B, C and X to speech response controller 71. The output code B designates the sentence "Please confirm one digit at a time". The output code C designates a sentence "The first digit is". The output code X designates number speech data "zero". In this manner, the sentences or words corresponding to a plurality of output codes are produced in the designated order.

What we claim is:

1. An individual verification apparatus comprising:

a verification data file in which key codes set by customers, speech reference data file in which key codes set by customers, speech reference data for the key codes spoken by the customers and name speech reference data for names of the customers spoken by themselves are registered;

speech input means for providing speech data including key code data in response to an input speech from a customer;

memory means coupled to said speech input means for storing key code data spoken by the customer and provided by said speed input means;

key code recognition means coupled to said memory means for recognizing the key code of the customer on the basis of the key code data spoken by the customer and stored in said memory means through said speech input means; and speaker verifying means coupled to said verification data file, said speech input means and said memory means for verifying the customer by comparing the key-code speech data stored in said memory means wth the key-code speech reference data of customers hvaing the key code recognized by said speech recognition means and previously registered in said verification data file, said speaker verifying means being arranged to, when the key code of the customer is recognized by said speech recognition means but the customer cannot be verified by the key-code speech data, verify the customer by comparing name speech data spoken by the customer and stored in said memory means through said speech input means with the name speech reference data of the customers having the key code which has been recognized by said speech recognition means and previously registered in said verification data file.

2. An apparatus according to claim 1 further comprising:

speech responding means coupled to said speech recognition means and said speaker verfification means for audibly indicating to the customer the key code recognized by said speech recognition means and a result of the speaker verification performed by said speaker verification means.

3. In an individual verification apparatus comprising a verification data file; a speech input section; a data memory; a speech recognition unit; a speaker verification unit; and a speech response section, a method for verifying a speaker comprising the steps of:

storing input speech data of the key code spoke by a speaker into said data memory through said speech input section;

recognizing the key code of the speaker by said speech recognition unit on the basis of the input speech data of the key code stored in said data memory;

verifying the speaker by said speaker verification unit, after the key code of the speaker has been recognized by comparing the key code speech data of the speaker stored in said data memory with key code reference speech data of customers, having the same key code which has been recognized by said speech recognition unit, previously registered in said verification data file;

urging, when the speaker cannot be verified on the basis of the key code speech data, the speaker to state his or her name by said speech response section;

storing, when the key code of the speaker is recognized by said speech recognition unit (40) but the speaker cannot be verified by said speaker verification unit on the basis of the key-code speech data, the name speech data spoken by the speaker into said data memory through said speech input section; and verifying the speaker by said speaker verification unit by comparing the name speech data stored in said data memory with name speech reference data of customers previously registered in said verification data file.

4. An individual verification apparatus comprising:

a verification data file in which identification codes set by customers, speech reference data for the identification codes uttered by the customers and name speech reference data for names of the customers spoken by themselves are registered;

speech input means for providing speech data including identification code data in response to an input speech from a customer;

memory means coupled to said speech input means for storing identification code data uttered by the customer and provided by said speech input means;

identification code recognition means coupled to said memory means for recognizing the identification code of the customer on the basis of the identification code data uttered by the customer and stored in said memory means through said speech input means; and speaker verifying means coupled to said verification data file, said speech input means and said memory means for verifying the customer by comparing the identification speech data stored in said memory means with the identification code speech reference data of customers having the identification code recognized by said speech recognition means and previously registered in said verification data file, said speaker verifying means being arranged to, when the identification code of the customer is recognized by said speech recognition means but the customer cannot be verified by the identification code speech data, verify the customer by comparing name speech data spoken by the customer and stored in said memory means through said speech input means with the name speech reference data of the customers having the identification code which has been recognized by said speech recognition means and previously registered in said verification data file.

5. An apparatus according to claim 4 further comprising speech responding means coupled to said speech recognition means and said speaker verification means for audibly indicating to the customer the identification code recognized by said speech recognition means and a result of the speaker verification performed by said speaker verification means.

6. In an individual apparatus comprising a verification data file; a speech input section; a data memory; a speech recognition unit; a speaker verification unit; and a speech response section, a method for verifying a speaker comprising the steps of:

storing input speech data of the identification code spoken by a speaker into said data memory through said speech input section;

recognizing the identification code of the speaker by said speech recognition unit on the basis of the inputted speech data of the identification code stored in said data memory;

verifying the speaker by said speaker verification unit, after the key code of the speaker has been recognized by comparing the identification code speech data of the speaker stored in said data memory with identification code reference speech data of customers, having the same identification code which has been recognized by said speech recognition unit, previously registered in said verification data file;

urging, when the speaker cannot be verified on the basis of the key code speech data, the speaker to state his or her name by said speech response section;

storing, when the identification code of the speaker is recognized by said speech recognition unit but the speaker cannot be verified by said speaker verification unit on the basis of the identification code speech data, the name speech data spoken by the speaker into said data memory through said speech input section; and verifying the speaker by said speaker verification unit by comparing the name speech data stored in said data memory with name speech reference data of customers previously registered in said verification data file.

* * * * *